United States Patent [19]

Johnson

[11] 4,045,757

[45] Aug. 30, 1977

[54] THERMOSTATIC SWITCH

[75] Inventor: Robert A. Johnson, Shelby, N.C.

[73] Assignee: Fasco Industries, Inc., Boca Raton, Fla.

[21] Appl. No.: 682,500

[22] Filed: May 3, 1976

[51] Int. Cl.[2] ..... H01H 37/52

[52] U.S. Cl. ..... 337/85; 337/88; 337/89

[58] Field of Search ..... 337/85, 88–91, 337/111, 113, 341, 365, 379; 318/473

[56] References Cited

U.S. PATENT DOCUMENTS

| | | | |
|---|---|---|---|
| 2,255,169 | 9/1941 | Ireland | 337/365 |
| 2,267,463 | 12/1941 | Hood et al. | 337/85 |
| 3,292,070 | 12/1966 | Hischak | 337/379 |
| 3,718,162 | 2/1973 | Dafler et al. | 337/111 |
| 3,818,403 | 6/1974 | Ambler | 337/85 |
| 3,818,404 | 6/1974 | Senor et al. | 337/85 |

*Primary Examiner*—William H. Beha, Jr.

[57] ABSTRACT

The switch includes a generally J-shaped, bimetallic switch arm having two, spaced, parallel legs, one of which is longer than the other. The shorter leg is welded at its outer end to a metal boss, which is formed on the face of a mounting bracket, and thus supports the longer leg above the face of the bracket so that a first contact on the outer end of the longer leg overlies, and is normally engaged with, a second contact, which is mounted on said bracket to be insulated therefrom. The high expansion side of the switch arm faces downwardly to confront the bracket, and since the shorter leg responds more rapidly to temperature changes than the longer leg, it tends to resist movement of the longer leg between open and closed positions and thereby prolongs the time the switch arm remains in either position.

3 Claims, 3 Drawing Figures

THERMOSTATIC SWITCH

This invention relates to switches, and more particularly to small, thermostatic switches of the type frequently used as circuit breakers in electrical appliances, and the like. Even more particularly, this invention relates to a circuit breaker having a current-carrying, bimetallic switch arm which opens or closes automatically in response to predetermined changes in its ambient temperature.

Temperature-responsive thermostatic switches of the type described are frequently utilized as current-carrying devices which protect electric motors, or the like, from undesirable overheating or burn-out. Typically such a thermostat has a bimetallic switch arm, which is normally disposed in a closed position to conduct current to the motor. If, however, for some reason the ambient temperature of the switch rises above a predetermined value, for example as the result of the flow of an excessive amount of current in the motor winding, then the bimetallic switch arm opens to deenergize the motor.

Each time a switch of this type opens and closes (i.e., its contacts make or break a circuit), the current in the circuit tends to arc or jump across the gap between the two contacts of the switch immediately upon the opening or closing thereof. This undesirable arcing, which tends to deteriorate the contacts of the switch, is minimized by designing the bimetallic switch arm so that it will move rapidly between its open and closed positions. Moreover, the life of the switch can be extended even further by prolonging the time that the switch remains open, each time it is moved to its open position as a result of circuit overload or the like.

Heretofore various forms and configurations of thermostatic switches of the type described have been designed to prolong the interval during which such a switch remains open each time it is tripped. Prior such switches, however, have generally been rather expensive to manufacture and difficult to calibrate, and have relied upon reverse bends in the bimetallic switch arms, or special welds or attachments to the arms for prolonging the open interval.

It is an object of this invention, therefore, to provide an improved thermostatic switch of the type described, which is substantially more compact and inexpensive to manufacture than prior such switches.

Another object of this invention is to provide a thermostatic switch of the type described which utilizes a plane, generally flat bimetallic switch element which does not require therein any reverse bends or special welds to achieve an extended opening time therefor.

Still another object of this invention is to provide an improved thermostatic switch or circuit breaker of the type described which will exhibit substantially longer life than prior such switches.

Other objects of the invention will be apparent hereinafter from the specification and from the recital of the appended claims, particularly when read in conjunction with the accompanying drawing.

Figure 1:
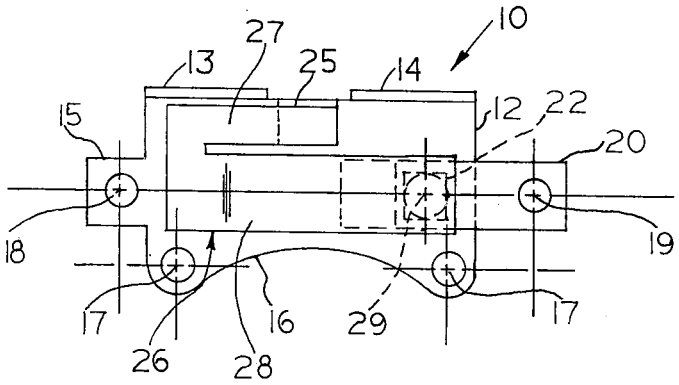
FIG. 1 is a plan view of a thermostatic switch made according to one embodiment of this invention.
Figure 2:
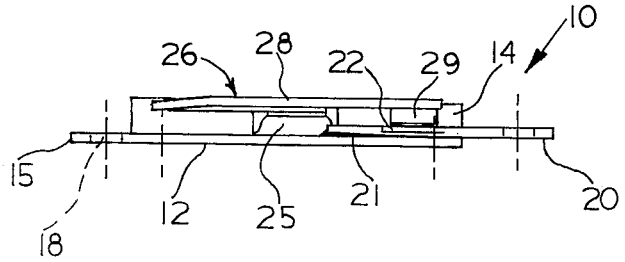
FIG. 2 is a side elevational view of this switch.
Figure 3:
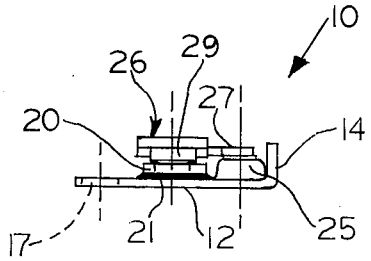
FIG. 3 is an end elevational view of the switch as seen when looking toward its right end as illustrated in FIG. 2.

Referring now to the drawing by numerals of reference, 10 denotes generally a thermostatic switch or circuit breaker comprising a metal bracket 12 having a pair of spaced, upright flanges 13 and 14 extending along the rear edge thereof, and having an integral, rectangular terminal or tab 15 projecting beyond one end thereof (the left end in FIGS. 1 and 2). Bracket 12 has an arcuate recess 16 in its forward edge, and has therethrough a pair of circular openings 17 located adjacent opposite ends of its forward edge for use in mounting the bracket on the equipment with which the switch is to be employed. The tab 15 also has therethrough an opening 18 for use in mounting the bracket.

A steel terminal 20, which is rectangular in configuration, is secured at one end by a thin layer 21 of a dielectric epoxy adhesive to the upper surface of bracket 12 at the right end thereof (FIG. 1), and approximately midway between the forward and rear edges of the bracket. Terminal 20 projects beyond the adjacent (right) end of the bracket 12 and has therein an opening 19 for use in securing thereto a wire lead or the like. Adjacent its inner end or left end (FIG. 1) the steel terminal 20 has thereon a rectangular metal contact 22, which in the embodiment illustrated is a thin layer of silver inlaid into a registering recess formed in the upper surface of the terminal. Alternatively contact 22 may be a segment of electrically conductive contact tape welded to steel terminal 20.

Between the two flanges 13 and 14 the bracket 12 has formed thereon an embossed metal pad 25, which is generally rectangular in confrontation, and which is disposed substantially medially of the ends of the bracket. Supported at one end on the pad 25 is a generally J-shaped, bimetallic switch arm 26, which has a pair of spaced, parallel legs 27 and 28 that are integral with each other at their inner ends (left ends in FIG. 1). At its outer, terminal end, leg 27, which is substantially shorter and slightly narrower than leg 28, is welded to the plane upper surface of the pad 25 so that leg 27 extends from the pad 25 toward the left hand end (FIG. 1) of bracket 12 parallel to flange 13, and in vertically spaced relation to the upper surface of bracket 12. Leg 27 supports the other leg 28 of switch arm 26 substantially centrally of bracket 12 and in spaced relation to its upper surface. The terminal or outer end of leg 28 overlies the contact 22 and has fixed to its underside an electrical contact 29, which is normally engaged with the contact 22 on terminal 20.

In use, the switch 10 is adapted to have circuit leads electrically connected to its tab 15 and to its terminal 20 in known manner. Since contact 29 normally is engaged with the contact 22, current will flow from one lead through the bracket 12, its pad 25, and the arm 26 to contact 29, and then through the contact 22 and the terminal 20 to the other circuit lead, or vice versa. Assuming that the switch 28 is designed so that its high expansion side faces downwardly, the underside thereof will expand more rapidly than the upper side, when exposed to heat, and the action of the bimetallic blade 26 will be such that its longer leg 28 will deflect in a direction which tends to separate the contact 29 from the contact 22. However, at the same time that the elevated temperature is causing leg 28 to swing upwardly (FIG. 2) at its right end, the shorter leg 27 will also be expanding more rapidly at this time along its underside, and will therefore tend to raise its left end (FIGS. 1 and 2) upwardly, or in a direction which counters the upward movement of leg 28, and which therefore tends to hold the contacts 29 and 22 engaged. However, because leg 28 is longer than leg 27, eventually its deflection will be greater for a given temperature change, and it will overcome the counter deflection caused by the shorter leg 27, and therefore ultimately will overcome the increase in contact pressure which is brought about by the shorter leg 27, thereby causing the contact 29 to snap away from contact 22 to open the circuit.

The advantage of a construction of this type is that the shorter leg 27, because it is smaller (both lengthwise and widthwise) than the longer leg 28, it will cool more rapidly than leg 28, and when it does, it will widen the gap between the contacts 22 and 29, when the switch is open, thereby causing the circuit breaker 10 to stay open for a longer or extended period of time, as compared, for example, to a bimetallic switch of the normal variety. Usually this extended time period can be anywhere from 5 to 30 seconds. Eventually, after prolonged cooling, the larger portion 28 of the blade or arm 26 cools to the point where it overcomes the effect of the shorter switch arm 27, and consequently returns the contact 29 to its closed position against the contact 22.

The novelty of this approach is that the opened time of the thermostat is extended merely through the use of a single, stamped bimetal switch arm 26, which is generally J-shaped in configuration, whereby one leg is shorter than the other, and each tends to counter the deflection of the other. Such a switch does not require the formation therein of any reverse bends or special welds. Providing this extended opened time allows increased contact life, and consequently the overall life of the circuit breaker itself. This is particularly true when the breaker is subjected to sustained overloads where a reduction in the number of makes and breaks of the switch in a given period of time will considerably prolong its life.

Although in the embodiment illustrated there are two spaced flanges 13 and 14 formed along the rear edge of bracket 12, it will be apparent that a single, continuous flange could be employed along this edge without departing from the invention. Moreover, while this invention has been illustrated and described in detail in connection with only a single embodiment thereof, it will be apparent that it is capable of further modification, and this application is intended to cover any such modifications as may fall within the scope of one skilled in the art or the appended claims.

Having thus described my invention, what I claim is:

1. A thermostatic switch, comprising a metal support having thereon a plane surface, a generally J-shaped, bimetallic switch arm having a pair of spaced parallel, generally flat legs integral with each other at their inner ends, and movable relative to each other at their outer ends, means for securing the outer end of one of said legs in electrical contact with said support and with said one leg supporting the other leg of said switch arm in spaced, confronting relation to said plane surface on said support, a first metal contact mounted on said support beneath the outer end of said other leg of said switch arm, a second metal contact secured to said outer end of said other leg for movement thereby to a closed position in which it engages said first metal contact, and to an open position in which it is spaced from said first contact, means electrically insulating said first contact from said metal support, and means for connecting said metal support and said first contact in an electrical circuit to pass current from said circuit through said contacts and from one end to the other of said switch arm, when said contacts are engaged, said one leg of said switch arm being substantially shorter and narrower than said other leg, said switch arm having its high expansion side facing said plane surface of said support, and said shorter leg of said switch arm being operative to resist movement of said longer leg in a direction to move said second contact from its open to its closed position, and the two legs of said switch arm being disposed substantially in a common plane when said contacts are engaged.

2. A thermostatic switch as defined in claim 1, wherein the first-named means comprises a boss projecting upwardly from said plane surface on said metal support and having said outer end of said one leg of the switch arm secured thereto, and said first contact is carried by a metal terminal which is secured at one end on said plane surface of said bracket by a layer of dielectric, epoxy adhesive.

3. A thermostatic switch as defined in claim 2, wherein said first metal contact comprises a strip of electrically conductive contact tape secured in electrical contact with said metal terminal.

* * * * *